United States Patent [19]

Knieriemen

[11] Patent Number: 4,688,641

[45] Date of Patent: Aug. 25, 1987

[54] WELL PACKER WITH RELEASABLE HEAD AND METHOD OF RELEASING

[75] Inventor: Jeffrey L. Knieriemen, Stafford, Tex.

[73] Assignee: Camco, Incorporated, Houston, Tex.

[21] Appl. No.: 889,539

[22] Filed: Jul. 25, 1986

[51] Int. Cl.[4] ..... E21B 29/00; E21B 33/129

[52] U.S. Cl. ..... 166/387; 166/120; 166/123; 166/376

[58] Field of Search ..... 166/387, 123, 127, 125, 166/181, 120, 376

[56] References Cited

U.S. PATENT DOCUMENTS

| | | | |
|---|---|---|---|
| 3,631,925 | 1/1974 | Nutter | 166/123 X |
| 4,307,781 | 12/1981 | Preston, Jr. et al. | 166/123 |
| 4,572,290 | 2/1986 | Clifton | 166/123 |

*Primary Examiner*—Stephen J. Novosad
*Attorney, Agent, or Firm*—Fulbright & Jaworski

[57] ABSTRACT

A well packer adapted to be set in a well conduit and includes a mandrel, a packing seal surrounding the mandrel and slips positioned above the packing seal against an abutment. The abutment is connected to a latching head and to the mandrel. A connection is positioned adjacent the lower end of the latching head which can be broken for releasing the latching head and preferably the abutment from the mandrel for allowing the milling out of the packer without the necessity of milling the latching head. The packer is released by an upward jar on the latching head for retrieving the latching head in some embodiments and by chemical cutting in another embodiment. The packer slips are then milled out for releasing the packer for upward movement.

11 Claims, 8 Drawing Figures

WELL PACKER WITH RELEASABLE HEAD AND METHOD OF RELEASING

BACKGROUND OF THE INVENTION

Permanent or nonretrievable type packers are frequently used in well conduits in oil and/or gas wells. While such permanent or nonretrievable packers are normally not removed from the well conduit, there are some occasions which require that such packers be removed. In such event, a milling tool is lowered through the well conduit and the packer is milled up until at least the slips holding the packer from moving upwardly in the well conduit are destroyed. After this, the packer may be moved upwardly and out of the well conduit. However, such a procedure requires milling down all of the packer above the upper slips which becomes an expensive and time-consuming operation. Furthermore, this milling operation becomes much more difficult when used on packers made of so-called premium material such as materials with high chromium and/or nickel content including stainless steels, duplex, monels, and inconels.

The present invention is directed to a normally permanent well packer and method for simplifying the release and milling operation required to mill and retrieve such a packer.

SUMMARY

The present invention is directed to a well packer adapted to be set in a well conduit including a mandrel, packing seal means and slip means surrounding the mandrel. A head is connected to the mandrel and breakable means, either frangible or easily cuttable, are provided adjacent the lower end of the head for releasing the head from the mandrel for allowing the milling out of the packer without the necessity of milling the head.

A further object is the provision of a well packer adapted to be set in a well conduit including a mandrel, packing seal means surrounding the mandrel, slip means surrounding the mandrel and positioned above the packing means, and means supported from the mandrel for expanding the packer seal means and the slip means. A latching head is connected to the mandrel and adapted to be connected to a well tubing, and an abutment is connected to the latching head and positioned above and engaging the slip means. Frangible means are provided adjacent the lower end of the latching head for releasing the latching head and abutment from the mandrel for allowing milling the packer without the necessity of milling the latching head.

Still a further object of the present invention is wherein the frangible means includes a shear pin connection between the latching head and the mandrel.

Yet a still further object of the present invention is wherein the frangible means includes a thin-walled section in the mandrel below the connection between the latching head and the mandrel.

A still further object of the present invention is wherein the frangible means includes a ratchet and tooth connection between the latching head and the mandrel.

Still a further object is wherein the frangible means includes a threaded connection between the latching head and the mandrel having a predetermined strength and/or controlled engagement area.

Still a further object of the present invention is wherein the packer includes premium material.

Yet a further object is the provision of a well packer having a mandrel and head made of premium material and an abutment for engaging the slip means which is of an easily millable material in which a breakable connection is provided for releasing the head but leaving the abutment and slips for milling.

Still a further object is the provision of a well packer with a profile for receiving chemical cutting equipment for assuring breaking or cutting the latching head away from the packer mandrel at the proper location.

A further object is the method of retrieving a normally nonretrievable well packer out of a set position in a well conduit in which the packer includes a head connected to a mandrel and slip means on the mandrel. The mandrel includes providing a breakable connection in the packer adjacent the lower end of the head, breaking the breakable connection for disconnecting the head from the mandrel, removing the head, milling out the slip means, and removing the milled packer from the conduit.

Still a further object of the present invention is the method of retrieving a normally nonretrievable well packer out of a set position in a well conduit in which the well packer includes a latching head connected to a mandrel, an abutment connected to the latching head and positioned against slip means on the mandrel. The method includes providing a frangible connection in the packer adjacent the lower end of the latching head, exerting a releasing force on the latching head from the well surface to break the frangible connection for disconnecting the latching head from the mandrel, removing the latching head from the well conduit, milling out the slip means for releasing the packer for upward movement from the well conduit, and removing the milled packer from the well conduit.

The method further comprehends removing the abutment while removing the latching head.

Other and further objects, features and advantages will be apparent from the following description of presently preferred embodiments of the invention, given for the purpose of disclosure, and taken in conjunction with the accompanying drawings.

DESCRIPTION OF THE PREFERRED EMBODIMENTS

While the present invention will be described in connection with a type HSP-1 permanent packer sold by Camco, Incorporated, for purposes of illustration only, the present invention is useful with other types of permanent or nonretrievable type packers and in particular for those packers which utilize so-called premium materials in whole or part.

Figure 1A:
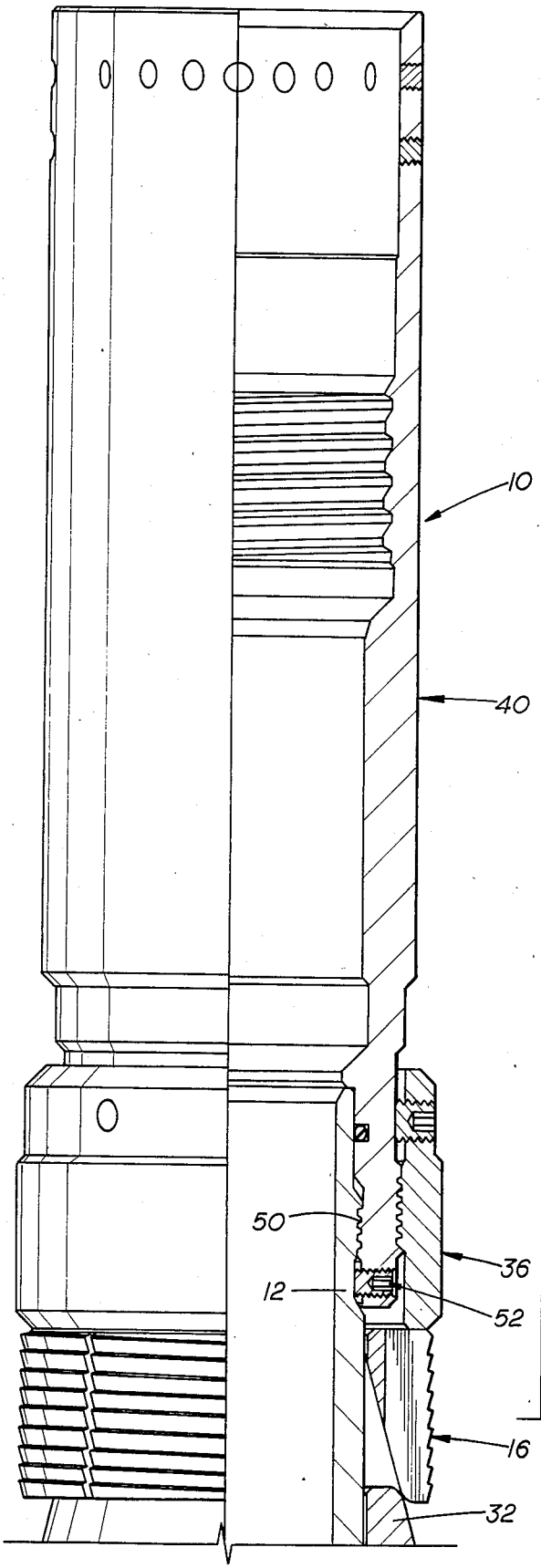
FIGS. 1A, 1B and 1C are continuations of each other and are elevational views in quarter section of the present invention being used with one type of well packer.
Figure 1B:
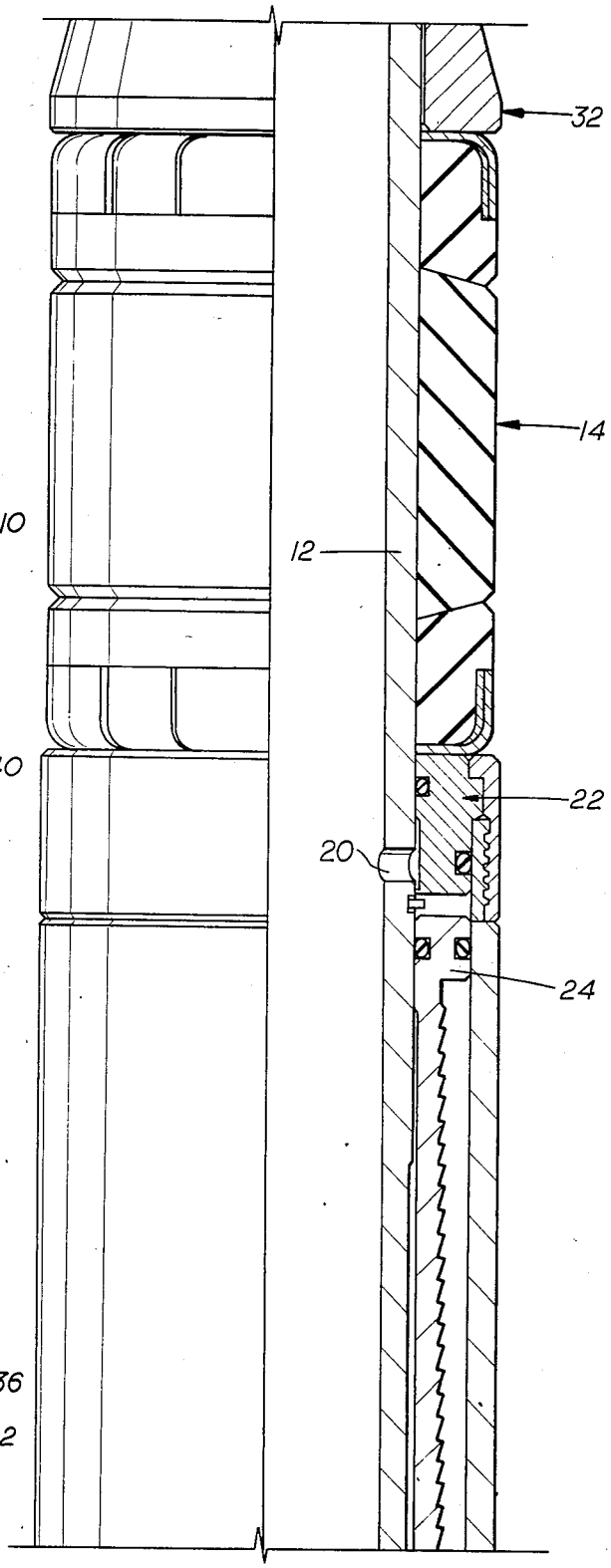
Figure 1C:
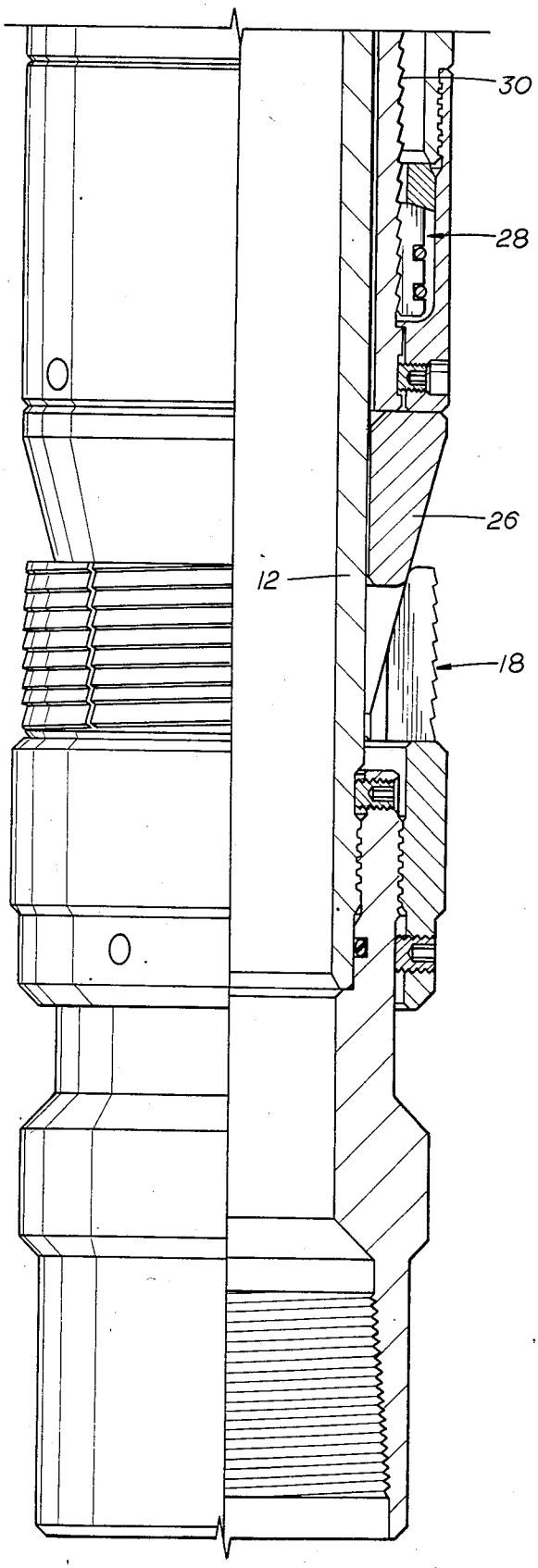

Referring now to the drawings and particularly to FIGS. 1A, 1B and 1C, the reference numeral 10 generally indicates the well packer of the present invention which generally includes a mandrel 12, the usual packer sealing means 14 for sealing against a well conduit, and slip means which includes upper slips 16 and lower slips 18 for engaging the inside of a well conduit and for preventing upward and lower movement, respectively, of the packer 10 after it is set.

While packers may be set in various ways, the particular packer 10 shown is a hydraulic set packer in which hydraulic fluid enters a port 20 in the mandrel 12 and is applied to pistons 22 and 24 for setting the packer sealing means 14 and the slips 16 and 18. That is, downward movement of the piston 24 forces a cone 26 under the lower slips 18 for setting the slips 18 into engagement with the interior of a well conduit.

Upward movement of the piston 22 compresses the packer sealing means 14 and expands it outwardly into a sealing relationship with the interior of the well conduit as well as moving the cone 32 towards the upper slips 16 causing the slips 16 to be expanded outwardly into engagement with the interior of a well conduit. The lower slips 18, the upper slips 16 and the packer sealing means 14 are held in the set position by the coaction of a ratchet 28 and ratchet teeth 30.

The upper movement of the upper slips 16 is prevented to allow the slips 16 to be set by being in engagement with an abutment 36 which is connected to a head or latching head 40 which in turn in connected to the mandrel 12.

The above-described well packer is well known and when energized and set forms a permanent or nonretrievable type packer in a well conduit. That is, such a packer does not have any releasing mechanism such as shown in U.S. Pat. No. 3,456,723. Therefore, in the event that for some reason it is necessary to remove the packer 10, it has been conventionally removed by using a milling tool to mill down the latching head 40, the abutment 36 and the upper slips 16. After this has been done, the packer 10 may then be removed from the well conduit since the slips 16 holding the packer 10 against upward movement have been destroyed.

Such a removal process is time-consuming and expensive. In addition, such a removal process becomes much more difficult when the packer including the head or latching head 40 is made out of so-called premium materials such as stainless steel and above, high nickel, high chromium, duplex, inconel and the like, all of which are extremely difficult to mill. These materials are extremely difficult to mill out and therefore greatly increase the time factor and costs for removing such a packer.

The present invention is directed to providing a frangible means adjacent the lower end of the latching head 40 for releasing the head and preferably also the abutment 36 from the mandrel 12 in order that they may be retrieved from the well conduit without milling. With the latching head 40 and the abutment 36 removed, the packer 10 may more easily be milled out as only the upper slips 16 which are now exposed can be milled and thereafter the packer 10 can be retrieved by lifting it out of the well conduit.

Referring now to FIG. 1A, one means for providing the frangible means for releasing the latching head 40 from the mandrel 10 is the provision of a threaded connection 50 which while having sufficient strength to support the packer 10 and also to hold the abutment 36 against the setting pressure of the upper slips 16, is weaker than the latching head 40 or mandrel 12 and sufficiently frangible so that it may be broken by an upward jar on the latching head 40. An upward jar will also break the set screw 52 which is normally used for the purpose of preventing rotational disconnection of the joint between the latching head 40 and the mandrel 12. Therefore, by using a conventional jarring tool which grips the latching head 10, an upward jar may be taken on the latch head 40 shearing the threaded connection 50 thereby disconnecting the latch head 40 from the mandrel 12. Thereafter, a conventional milling tool may be lowered into the well conduit around the exterior of the now-exposed mandrel 12 for milling away the upper slips 16. With the slips 16 destroyed, the remaining portion of the packer 10 can be pulled out of the well conduit.

Other and further types of frangible means may be provided for releasing the latching head 40 from the mandrel 12. Such further embodiments will be described wherein like parts to those in FIGS. 1A will be similarly numbered with the addition of the suffix "a".

Figure 2:
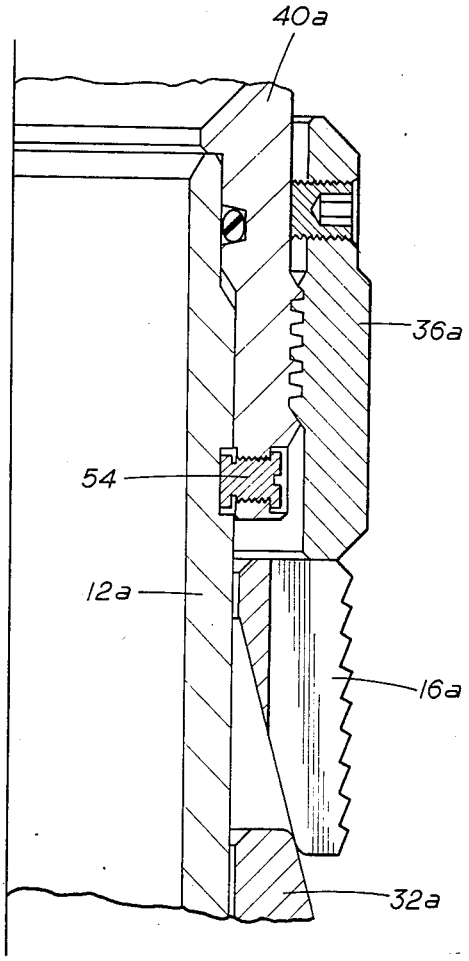
FIG. 2 is an enlarged fragmentary elevational view in cross section of another form of the present invention.

Referring now to FIG. 2, the head **40*a* is connected to the mandrel 12*a* by one or more shear pins 54 instead of the usual threads. Again, the frangible means, the shear pins 54, have a sufficient strength to support the abutment 36*a* for resisting the setting of the upper slips 16, but can be sheared by an upward jar on the head 40*a*. Again, release of the head 40*a* from the mandrel 12*a* will allow the removal of the head 40*a* and abutment 36*a* from the well conduit so that only the upper slips 16*a*** need to be milled.

Figure 3:
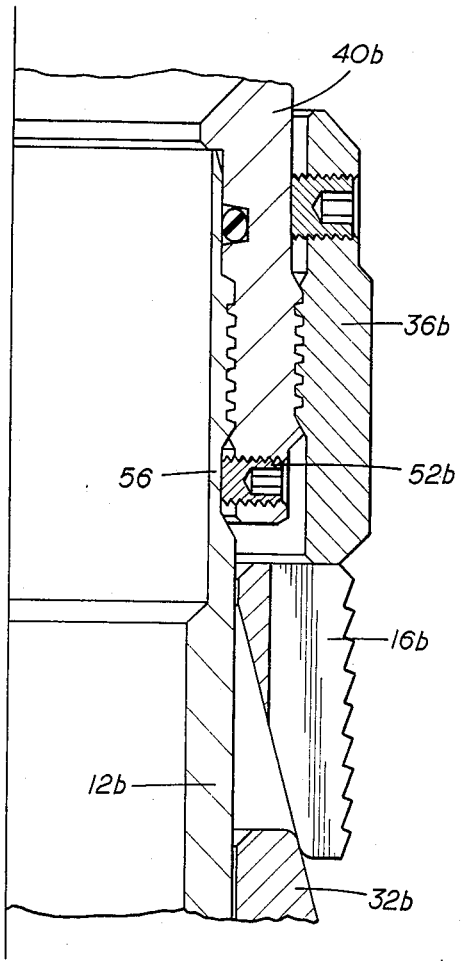
FIG. 3 is an enlarged fragmentary elevational view in cross section of an further embodiment of the present invention.

Referring now to FIG. 3, the frangible means includes a thin-walled section 56 in the mandrel **12*b* below the connection of the latch head 40*b* to the mandrel 12*b*. Therefore, when an upward jar is taken on the latch head 40*b*, the then-walled section 56 will separate allowing the removal of the latch head 40*b* and the abutment 36*b***.

Figure 4:
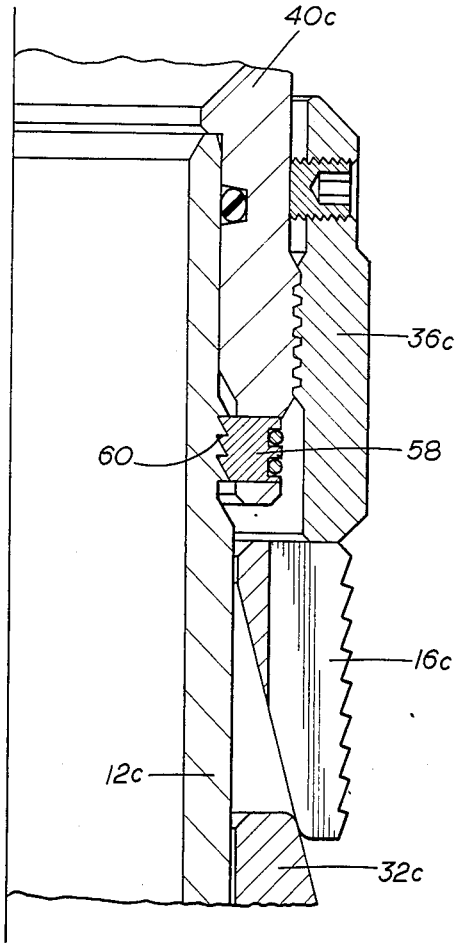
FIG. 4 is an enlarged fragmentary elevational view in cross section of a still further embodiment of the present invention.

Referring now to FIG. 4, a further embodiment is shown in which the connection between the latch head **40*c* in the mandrel 12*c* is by a ratchet 58 carried by the latch head 40*c* and coacting threads 60 on the mandrel 12*c*. The ratchet 58 and coacting ratchet threads 60 are sufficient to withstand the necessary normal forces required to support the mandrel from the latch head 40*c* but are shearable upon an upward jar on the latch head 40*c*. Again, in this embodiment, the latch head 40*c* and the abutment 36*c* may be removed thereby avoiding milling of these components when removing the permanent packer 10**.

Figure 5:
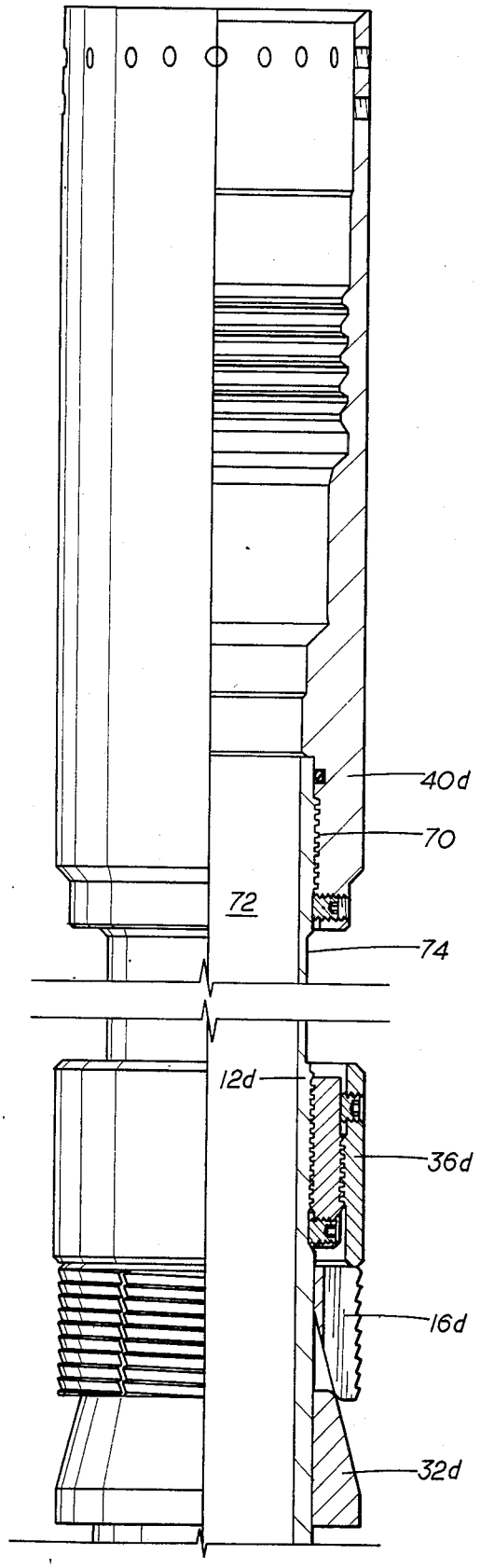
FIG. 5 is an enlarged fragmentary elevational view in cross section of another embodiment.

Referring now to FIG. 5, the head **40*d* is connected to the mandrel 12*d* by threads 70 and the head 40*d* and mandrel 12*d* are of a premium material for conducting the well fluids in the bore 72. The abutment 36*d* is connected to the mandrel 12*d*. The abutment 36*d* may be of an easily millable material such as cast or mild steel and need not be of a premium material as it is isolated from the bore 72. The frangible means may be a narrow groove 74 which may be sheared by an upward jar. This removes the hard to mill head 40*d* whereby the packer can be removed after milling the abutment 36*d* and the slips 16*d***.

Figure 6:
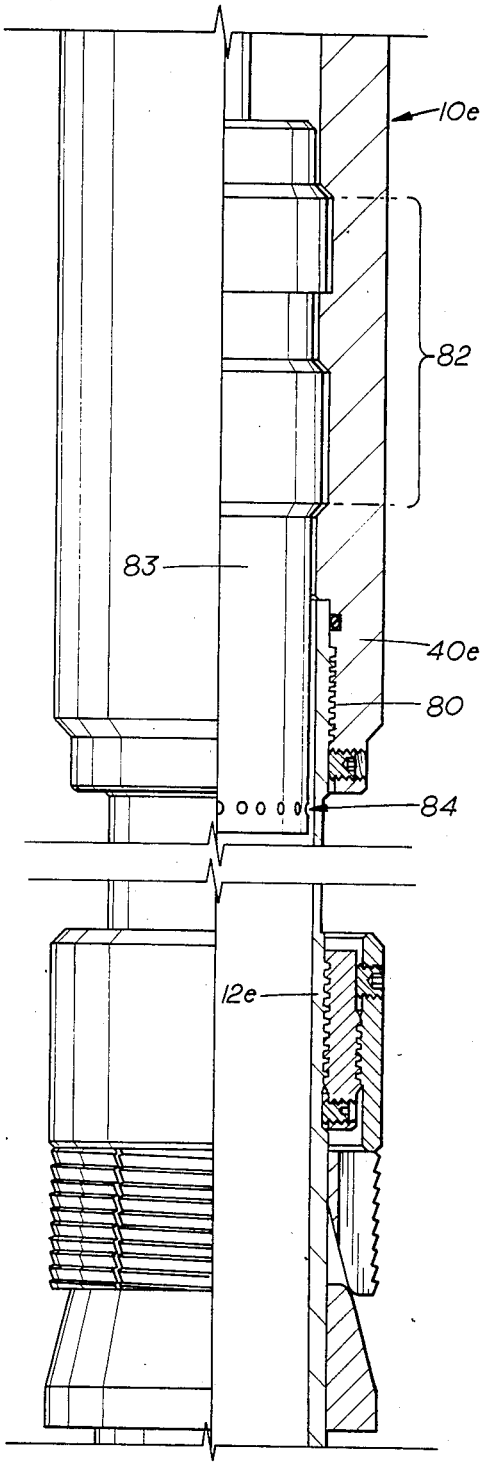
FIG. 6 is an enlarged fragmentary view of still a further embodiment.

Referring now to FIG. 6, the head **40*e* is connected to the mandrel 12*e* by threads 80 and the head 40*e* and mandrel 12***e* are of a premium material. A no go shoulder or a selective type locator profile 82 is provided in the interior of the head 40*e* or mandrel 12*e*, here shown as in the head 40*e*. The shoulder or profile 82 is positioned adjacent the connection 80 for receiving a cutter such as a conventional chemical cutter 83. The profile is spaced to allow the cutter 83 to make a cut in the mandrel 12*e* at a point below the connection 80 but above the slips, for example at circumference point 84. Therefore, when it is desired to remove the packer 10*e*, the cutter 83 is moved down the well tubing to the packer 10*e* and is positioned in the profile 82 and cuts the mandrel 12*e* below the connection 80. The cutter 83 and head 40*e* are removed whereby the packer 10*e* can be removed after milling the slips.

The method of the present invention is apparent from the foregoing description of the apparatus. However, the method includes retrieving a normally nonretrievable well packer out of a set position in well conduit in which the well packer includes a latching head connected to a mandrel, an abutment connected to the latching head and positioned against slip means on the mandrel. The method includes providing a frangible connection in the packer adjacent the lower end of the latching head, exerting a releasing force on the latching head from the well surface to break the frangible connection for disconnecting the latching head from the mandrel, and removing the latching head from the well conduit. The method comprehends thereafter milling out the slip means for releasing the packer for upward movement from the well conduit and removing the milled packer from the well conduit. The method includes removing the abutment while removing the latching head.

The present invention, therefore, is well adapted to carry out the objects and attain the ends and advantages mentioned as well as others inherent therein. While presently preferred embodiments of the invention have been given for the purpose of disclosure, numerous changes in the details of construction and arrangement of parts and steps of the method will be readily apparent to those skilled in the art and which are encompassed within the spirit of the invention and the scope of the appended claims.

What is claimed is:

1. A well packer adapted to be set in a well conduit comprising, a mandrel, packer sealing means surrounding the mandrel, slip means surrounding the mandrel, means supported from the mandrel for expanding the packer sealing means and the slip means, a latching head connected to the mandrel, an abutment connected to the latching head and positioned above and engaging the slip means, breakable means adjacent the lower end of the head for releasing the head from the mandrel for allowing the milling out of the packer without the necessity of milling the latching head.

2. The apparatus of claim 1 wherein the breakable means are frangible and includes, a shear pin connection between the latching head and the mandrel.

3. The apparatus of claim 1 wherein the breakable means are frangible and includes, a thin wall section in the mandrel below the connection between the latching head and the mandrel.

4. The apparatus of claim 1 wherein the breakable means are frangible and includes a ratchet and tooth connection between the latching head and the mandrel.

5. The apparatus of claim 1 wherein the breakable means are frangible and includes a threaded connection between the latching head and the mandrel having a predetermined strength less than the latching head and mandrel.

6. The apparatus of claim 1 wherein the packer is of premium materials.

7. A well packer adapted to be set in a well conduit comprising, a mandrel, packer sealing means surrounding the mandrel, slip means surrounding the mandrel and positioned above the packer sealing means, means supported from the mandrel for expanding the packer sealing means and the slips means, a latching head connected to the mandrel and adapted to be connected to a well tubing, an abutment connected to the latching head and positioned above and engaging the slip means, frangible means adjacent the lower end of the latching head for releasing the latching head and abutment from the mandrel for allowing the milling out of the packer without the necessity of milling the latching head.

8. A well packer adapted to be set in a conduit comprising, a mandrel, packer sealing means surrounding the mandrel, slip means surrounding the mandrel and positioned above the, packer sealing means, means supported from the mandrel for expanding the packing seal means and the slip means, a head connected to the mandrel, an abutment connected to the mandrel and positioned above and engaging the slip means, said mandrel and head being of a premium material, but said abutment being of an easily millable material, frangible means adjacent the lower end of the head for releasing the head from the mandrel for allowing the milling out of the abutment and slip means without the necessity of milling the head.

9. The method of retrieving a normally nonretrievable well packer out of a set position in a well conduit in which the well packer includes a head connected to a mandrel and slip means on the mandrel comprising, providing a breakable connection in the packer adjacent the lower end of the head, breaking the breakable connection for disconnecting the head from the mandrel, removing the head from the well conduit, milling out the slip means for releasing the packer for upward movement from the well conduit, and removing the milled packer from the well conduit.

10. The method of retrieving a normally nonretrievable well packer out of a set position in a well conduit in which the well packer includes a latching head connected to a mandrel, an abutment connected to the latching head and positioned against slip means on the mandrel comprising, providing a frangible connection in the packer adjacent the lower end of the latching head, exerting a releasing force on the latching head from the well surface to break the frangible connection for disconnecting the latching head from the mandrel, removing the latching head from the well conduit, milling out the slip means for releasing the packer for upward movement from the well conduit, and removing the milled packer from the well conduit.

11. The method of claim 10 including, removing the abutment while removing the latching head.

* * * * *